United States Patent [19]

Cure

[11] Patent Number: 4,850,572

[45] Date of Patent: Jul. 25, 1989

[54] PROCESS INTENDED TO PREVENT DEPOSITION ON THE WALLS OF METALLURGICAL CONTAINERS AND METALLURGICAL CONTAINERS SUITABLE FOR CARRYING OUT THIS PROCESS

[75] Inventor: Omer P. Cure, Diepenbeek, Belgium

[73] Assignee: Electro-Nite Co., Philadelphia, Pa.

[21] Appl. No.: 178,809

[22] PCT Filed: Apr. 8, 1986

[86] PCT No.: PCT/BE86/00010

§ 371 Date: Nov. 6, 1986

§ 102(e) Date: Nov. 6, 1986

[87] PCT Pub. No.: WO86/06307

PCT Pub. Date: Nov. 6, 1986

Related U.S. Application Data

[63] Continuation of Ser. No. 932,547, Nov. 6, 1986, abandoned.

[30] Foreign Application Priority Data

Apr. 19, 1985 [LU] Luxembourg ..... 85858

[51] Int. Cl.[4] ..... C21B 13/00; C21B 15/00

[52] U.S. Cl. ..... 266/44; 75/10.10; 75/10.65; 373/6; 373/20; 373/33

[58] Field of Search ..... 266/44; 75/10.10, 10.65; 373/6, 20, 33

[56] References Cited

U.S. PATENT DOCUMENTS

| | | | |
|---|---|---|---|
| 3,798,025 | 3/1974 | Ramachandran | 75/49 |
| 3,848,072 | 11/1974 | Dershem | 373/20 |
| 4,286,773 | 9/1981 | Kristiansen | 266/44 |
| 4,365,788 | 12/1982 | Block | 266/44 |
| 4,512,799 | 4/1985 | Mulcahy | 75/49 |

*Primary Examiner*—Peter D. Rosenberg

*Attorney, Agent, or Firm*—Panitch, Schwarze, Jacobs & Nadel

[57] ABSTRACT

A process intended to prevent the formation of metal deposits on the walls (1) of metallurgical containers in contact with the molten metal bath (12). An improved container for carrying out this process is also described. Formation of deposit can be prevented by applying an electric voltage between the molten bath (12) and the wall (1).

13 Claims, 1 Drawing Sheet

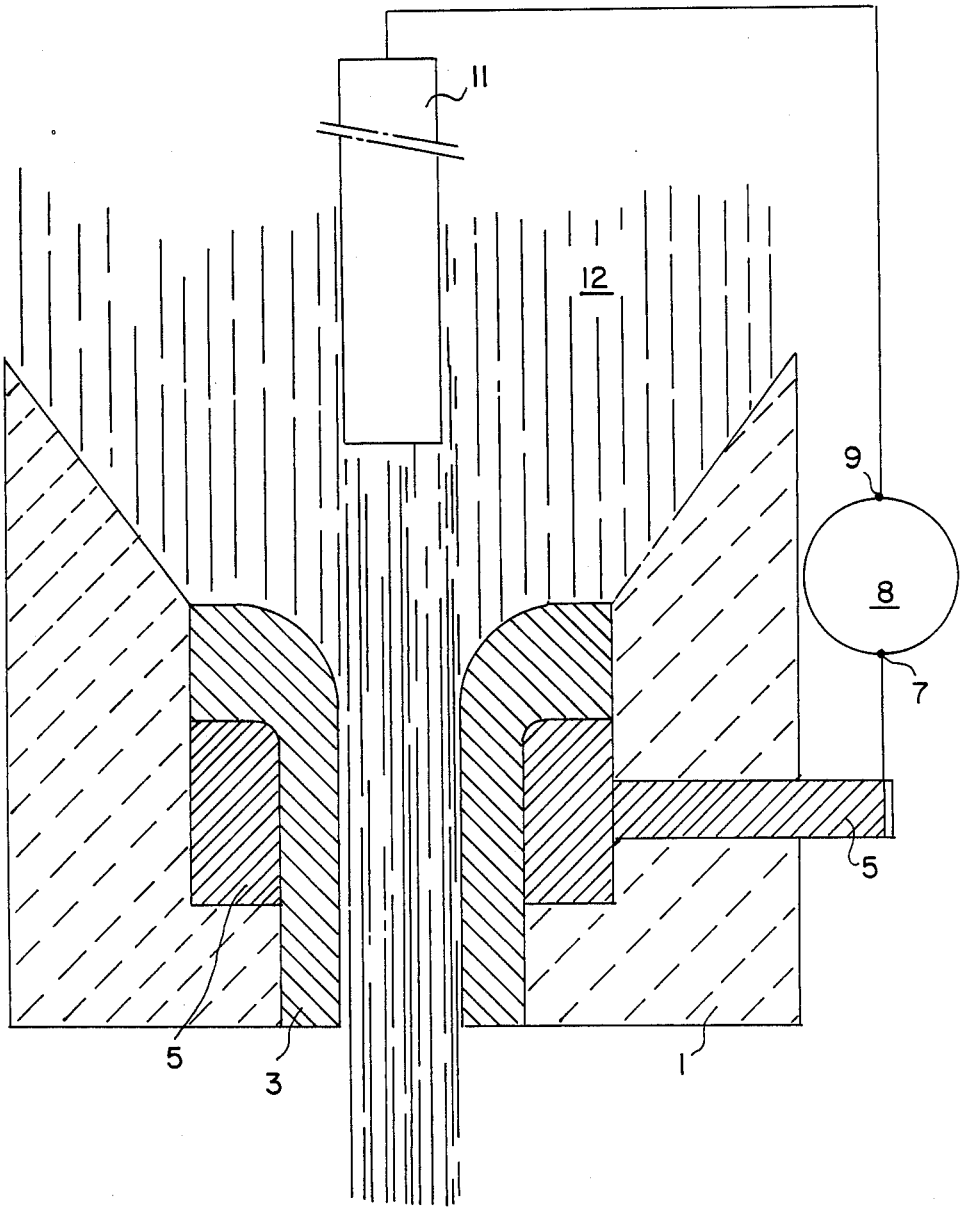
11
12
9
8
7
5
5
3
1

PROCESS INTENDED TO PREVENT DEPOSITION ON THE WALLS OF METALLURGICAL CONTAINERS AND METALLURGICAL CONTAINERS SUITABLE FOR CARRYING OUT THIS PROCESS

This application is a continuation of Ser. No. 06/932,547 filed Nov. 6, 1986, now abandoned.

BACKGROUND OF THE INVENTION

The present invention relates to a process intended to prevent deposition on the walls of metallurgical containers, particularly on the internal surfaces of the tap hole of these containers. It also concerns an improved metallurgical container which is suitable for carrying out the abovementioned process.

It is well known that the tap hole, especially of the distributor, represents a weak point in the chain of production using molten metal, more particularly in continuous casting processes. Various solutions have already been proposed, more particularly in the case of steel, as remedies for this problem,—see the papers, "Steel flow through nozzles: Influence of calcium", Faulring, Farrel and Hilty; Iron and steel-makers, February 1980, pages 14 to 20: and "Steel flow through nozzles: Influence of deoxidizers", Farrel and Hilty; Electric furnace proceedings AIME; Volume 29, 1971, pages 31 to 46 and GB-A-1 496 169; U.S. Pat. No. 3 848 072; PATENTS ABSTRACTS OF JAPAN, Vol. 7, no. 163 (M-229) (1308) and Vol. 9, no. 38 (M-358) (1761). It has thus been proposed to use self-eroding nozzles which prevent deposition of metallic materials, but which have to be replaced after relatively short operating periods and, besides, may influence the quality and the purity of the metallic bath.

It has also been proposed to clear the tap holes by means of oxygen lances.

Another means consists in using a nozzle which allows an inert gas to pass through and prevent direct contact between the molten metal and the walls of the tap hole and also avoid oxidation of the molten metal, this oxidation promoting the formation of deposits.

It has also been proposed to make additions of special substances to the molten metal, so as to make it more fluid and prevent deposition. Tests which were, in fact, conclusive have already been carried out with additions of calcium. In this case, however, it is essential to make the additions with great accuracy, depending on the previous treatment of the molten metal. Deoxidising agents have also been added, such as silica and manganese, aluminium, zirconium and titanium or rare earths. These rather chemical processes however affect the composition of the metal, in this case steel, and may prove to be relatively burdensome.

The aim of the present invention is to provide a process other than the mechanical and chemical processes mentioned, so as to prevent the formation of deposits on the walls of metallurgical containers.

Another aim of the present invention is to provide a process of the abovementioned type which does not exhibit the shortcomings of the processes of the state of the art, that is to say, a less costly process which depends to a lesser extent on the quality of the metal under treatment and on the treatment previously carried out and which is simple and easy to regulate.

The invention also aims at providing an improved metallurgical container which possesses an improved tap hole for enabling the process of the invention to be carried out.

SUMMARY OF THE INVENTION

According to a first feature of the present invention, the process is characterised by the fact that the formation of deposits is prevented on at least part of the walls of a metallurgical container by an electrochemical type of action, by applying an electric voltage between the molten metal bath and the essentially conductive wall of at least part of the metallurgical container. "Conductive" is taken to mean conduction of electricity by movement of electrons and by movement of positively or negatively charged ions.

According to a preferred embodiment of the present invention, a continuous electric voltage is applied between the molten bath and the essentially conductive wall of at least part of said metallurgical container. Advantageously, the electric voltage applied can be adjusted with respect to the molten metal bath and the speed of passage of the molten metal in the metallurgical container. It can also be adjusted so that a stabilised continuous current is maintained, being freed from the fluctuations caused by external factors.

Preferably, an electric voltage is applied between the molten bath and the nozzle of the tap hole.

It is observed that the process is easy to operate and that it enables the formation of deposits on the walls of the metallurgical container, particularly in the tap hole, to be effectively prevented. The preferably continuous electric voltage causes a (continuous) electric current to be set up between the wall of the container and a bath electrode. The said electric current prevents particularly the formation of deposits of aluminium oxides.

According to another feature of the present invention, the metallurgical container is characterised in that it is provided, at least partly, with a wall having an electrically conductive coating which is connected with a contact electrode connected to a first terminal of a source of electric voltage and in that it comprises an electrode immersed in the molten metal bath, which is connected to the second terminal of the source of electric voltage.

Advantageously, the electrode immersed in the molten metal bath consists of a graphite electrode.

Advantageously, the contact electrode is connected to the nozzle, preferably to the zirconium dioxide of the tap hole and envelops it at least partially. Contact can be brought about by means of a solid material or through the intermediary of a material which is molten at the working temperatures, such as, for example, copper.

The invention is described in greater detail below with the aid of the attached FIGURE which is a diagrammatic view of a tap hole equipped in accordance with the present invention.

It should be noted that the embodiment described is given only by way of example and that it is not intended to limit the scope of the present invention.

DETAILED DESCRIPTION OF THE DRAWING

With reference to the FIGURE, a metallurgical container, such as, for example, a casting distributor (tundish) is coated with a refractory cement of $Al_2O_3$ (1). The nozzle consists of a jet made of zirconium dioxide 3 which has a conventional shape and finish, that is to say, an essentially cylindrical duct and an induction port in the shape of a funnel, and is accommodated in a conical recess. Other shapes are however feasible and are not excluded by the present invention.

According to the invention, the jet 3 is surrounded by a contact electrode 5 which is connected to a first terminal 7 of a source of preferably continuous electric voltage, adjusted so as to generate a steady current. The other terminal 9 of this source of electric voltage is connected to a graphite electrode 11, immersed in the molten metal bath 12.

By applying an appropriate voltage between the graphite electrode 11 and the contact electrode 5, an electric current is produced which passes, at least partially and locally, through the molten metal and the zirconium oxide jet 3. In this way, the deposits which are in danger of being formed or which would already have been formed are "redissolved" in the bath by the electrochemical action.

The invention is evidently not limited to the embodiment described above. According to a particularly advantageous alternative form, an electric voltage between the molten metal baths and the tap hole can be applied by means of a voltage source located in situ and formed by the zirconium oxide coating is in at least partial contact with a medium different from the molten metal bath, that is to say, whose partial oxygen pressure is essentially different from that of the molten metal.

What is claimed is:

1. A process for the prevention of the formation of deposits within a nozzle of a metallurgical container containing a molten metal bath, the process steps comprising: applying an electric voltage across the molten metal bath within the container and a conductive wall portion of the nozzle so that an electric current flows between the molten metal bath and the conductive wall portion of the nozzle.

2. A metallurgical container for pouring a molten metal, the container comprising a nozzle within the wall of the container, means for applying an electric voltage across the molten metal and a conductive portion of the wall of the nozzle so that an electric current flows between the molten metal and the conductive portion for the prevention of deposits on the nozzle.

3. A process according to claim 1, further characterized in that the electric voltage is applied continuously across the molten metal bath and the conductive wall portion of the nozzle.

4. A process according to claim 1, further comprising the steps of applying a continuous electric voltage and adjusting the continuous voltage so that a stabilized current flows between the conductive wall portion of the nozzle and the molten metal bath.

5. A process according to claim 3, further characterized in that the electric voltage is applied by means of two electrodes connected to a voltage source, immersing the first electrode in the molten metal bath and forming the second electrode as an electrically-conducting coating.

6. A process according to claim 3, further characterized by developing an electric voltage by means of an emf source located in situ and formed by a conductive coating and a medium which is in at least partial contact with the coating and which has a partial oxygen pressure essentially different from that of the molten metal bath.

7. A metallurgical container according to claim 2 further comprising a wall having an electrically conductive coating (3) which is connected with a contact electrode (5) connected to a first terminal (7) of a source of electric voltage (8) and an electrode (11) adapted to be immersed in the molten metal bath (12), the electrode within the bath connected to a second terminal (9) of the source of electric voltage (8).

8. A metallurgical container according to claim 7, characterized in that the electrode (11) immersed in the molten metal bath (12) consists of a graphite electrode.

9. A metallurgical container according to either claim 7 or 9, further characterized in that the source of electric voltage is adapted to be adjusted so as to maintain a stabilized current.

10. A metallurgical container according to claim 8 characterized in that the contact electrode is connected to the nozzle and envelops it at least partially.

11. A metallurgical container according to claim 8, characterized in that contact between of the electrodes and the coating is brought about through the intermediary of a material which is molten at the working temperatures.

12. A metallurgical container according to claim 2, characterized in that the source of the voltage is formed by the molten metal bath, the conductive portion of the wall of the nozzle and a medium which is in at least partial contact with the conductive portion of the wall of the nozzle, the medium being of a material which is essentially different from the molten metal bath.

13. A metallurgical container according to claim 12, characterized in that the wall of the nozzle is made of zirconium oxide, the wall of the nozzle in at least partial contact with a medium whose partial oxygen pressure is different from that of the molten metal at the working temperatures.

* * * * *